United States Patent [19]

Hunt

[11] 4,171,484

[45] Oct. 16, 1979

[54] AUTOMATIC BRIGHTNESS CONTROL FOR DIRECT VIEW FLUOROSCOPIC IMAGING SYSTEMS

[75] Inventor: Robert P. Hunt, Menlo Park, Calif.

[73] Assignee: Diagnostic Information, Sunnyvale, Calif.

[21] Appl. No.: 925,404

[22] Filed: Jul. 17, 1978

Related U.S. Application Data

[63] Continuation-in-part of Ser. No. 821,618, Aug. 3, 1977, abandoned.

[51] Int. Cl.[2] ..... H05G 1/36

[52] U.S. Cl. ..... 250/355; 250/409

[58] Field of Search ..... 250/416, 409, 402, 213 VT, 250/355

[56] References Cited

U.S. PATENT DOCUMENTS

| | | | |
|---|---|---|---|
| 2,541,187 | 2/1951 | Ball et al. | 250/355 |
| 2,821,635 | 1/1958 | Ball et al. | 250/355 |
| 2,829,273 | 4/1958 | Fransen | 250/355 |
| 3,198,947 | 8/1965 | Arrison, Jr. et al. | 250/409 |
| 3,675,020 | 7/1972 | Sieband | 250/207 |

*Primary Examiner*—Alfred E. Smith
*Assistant Examiner*—T. N. Grigsby
*Attorney, Agent, or Firm*—Limbach, Limbach & Sutton

[57] ABSTRACT

An apparatus and method for controlling an X-ray generator in order to obtain a relatively constant output window brightness from a directly viewed X-ray image intensifier tube by introducing a small sinusoidal variation to the bias supply of the image intensifier tube and detecting only the resultantly modulated light component output from the phosphor display screen, the error signal thus derived being independent of dark current and power frequency components common to X-ray generated light output of the image intensifier tube.

9 Claims, 5 Drawing Figures

AUTOMATIC BRIGHTNESS CONTROL FOR DIRECT VIEW FLUOROSCOPIC IMAGING SYSTEMS

CROSS REFERENCE TO RELATED APPLICATION

This application is a continuation-in-part of my copending application, Ser. No. 821,618, now abandoned, entitled *AUTOMATIC BRIGHTNESS CONTROL FOR DIRECT VIEW FLUOROSCOPIC IMAGING SYSTEMS,* and filed on Aug. 3, 1977.

BACKGROUND OF THE INVENTION

This invention relates to a method and apparatus for controlling an X-ray generator to obtain a relatively constant output window brightness from a directly viewed X-ray image intensifier tube.

When an X-ray image intensifier tube is used in a fluoroscopic mode, the output screen is sometimes directly viewed and is therefore exposed to room ambient illumination. Since such ambient illumination can affect the brightness of the output screen display, it is desirable to provide apparatus for maintaining a constant brightness of the output display screen regardless of changes in the room ambient light level.

To date, prior art systems have sensed the entire photocathode current of the X-ray image intensifier tube. This technique cannot control scene highlights since the total photo current is a measure of the total X-ray radiation impinging on the tube. See for example, U.S. Pat. No. 3,198,947. In another technique, in which improved operating characteristics are achieved, a photomultiplier is light-coupled by mirrors and lenses to the output window of the image intensifier tube. A dc voltage is derived from the photosensor which is used to control the X-ray generator. See for example, U.S. Pat. Nos. 2,541,187; 2,821,635; and 2,829,273. Furthermore, lenses have been used to detect light coming only from the central portion of the output window, i.e., that portion which occupies most of the radiographer's attention. See U.S. Pat. No. 3,675,020, for example.

In other, less desirable approaches, X-ray sensors which are totally separate from the image intensifier tube are used to detect and control the total amount of X-ray radiation. The sensors generally take the form of ion chambers with sensitive electrometer tubes to dc amplify the ion and electron current formed by the ionizing radiation. Thus, a point source that is very bright could produce the same control signal, and hence the same X-ray dosage, as a broad area of X-ray illumination of much reduced intensity.

The problem becomes particularly acute when the X-ray image intensifier is of the proximity focus type, that is, the X-ray input window has approximately the same diagonal dimension as the output phosphor display screen. Because such devices do not utilize minification, the brightness of the output display is lower as compared to some prior art X-ray image intensifier tubes which do use the principle of minification. Also, the output window is more directly exposed to room ambient light conditions.

SUMMARY OF THE INVENTION

The above and other disadvantages of prior art brightness control systems are overcome by the present invention of an automatic brightness control apparatus for use with a variable intensity X-ray generator and an X-ray image intensifier tube of the type having a high voltage bias supply and an output phosphor display screen. The brightness control apparatus according to the invention comprises oscillator means for introducing a periodic variation in the bias supply voltage to the image intensifier tube, photo-optic sensor means for sensing the light output of the display screen and for producing an output signal which is representative of the variations in the intensity of the light output from the display screen, and means for phase detecting the periodically varying component of the photo-optic sensor means output signal due to the oscillator means and for thereby producing an X-ray generator intensity control signal. In the preferred embodiment the X-ray generator control signal is supplied to means which control the intensity of the output of the X-ray generator in response to the control signal. The photo-optic means further include a light filter which is interposed between the photo-optic sensor and the display screen for rejecting light wave-lengths which are different from the light wavelengths emitted by the output phosphor display screen. The photo-optic sensor means also include means for imaging a central portion, preferably 10% by area, of the output phosphor screen display onto the photosensor.

The oscillator means include an oscillator and a high voltage transformer. The oscillator is of a frequency which is significantly higher than the frequency of the power supply to the X-ray generator. In the preferred embodiment, the oscillator has a natural frequency of 400 Hz/sec. The high voltage transformer has a primary winding which is driven by the oscillator and a secondary winding which is connected in parallel with the high voltage bias supply of the image intensifier tube. The oscillator also supplies an output signal to the phase detection means. The other input to the phase detection means, as mentioned above, is the output of the photo-optic sensor means. By sensing only the 400 Hz ac component of the light emission from the X-ray image intensifier tube's output display screen and deriving a control signal from this component to control the X-ray generator intensity, the effects of ambient light as well as drifts in the bias voltage are eliminated. This control signal is independent of dark current and power frequency components common to both X-ray generated light output of the intensifier tube and to room light sources such as incandescent lamps and fluorescent light fixtures.

It is therefore an object of the present invention to provide apparatus for controlling the brightness of the output phosphor display screen of an X-ray image intensifier tube by sensing that output brightness and controlling the intensity of the X-ray generator in accordance therewith.

It is still another object of the present invention to provide automatic brightness control apparatus for an X-ray image intensifier tube which is not sensitive to the effects of ambient light as well as drifts in bias voltage.

The foregoing and other objectives, features and advantages of the invention will be more readily understood upon consideration of the following detailed description of certain preferred embodiments of the invention, taken in conjunction with the accompanying drawings.

DETAILED DESCRIPTION OF THE PREFERRED EMBODIMENT

Figure 1:
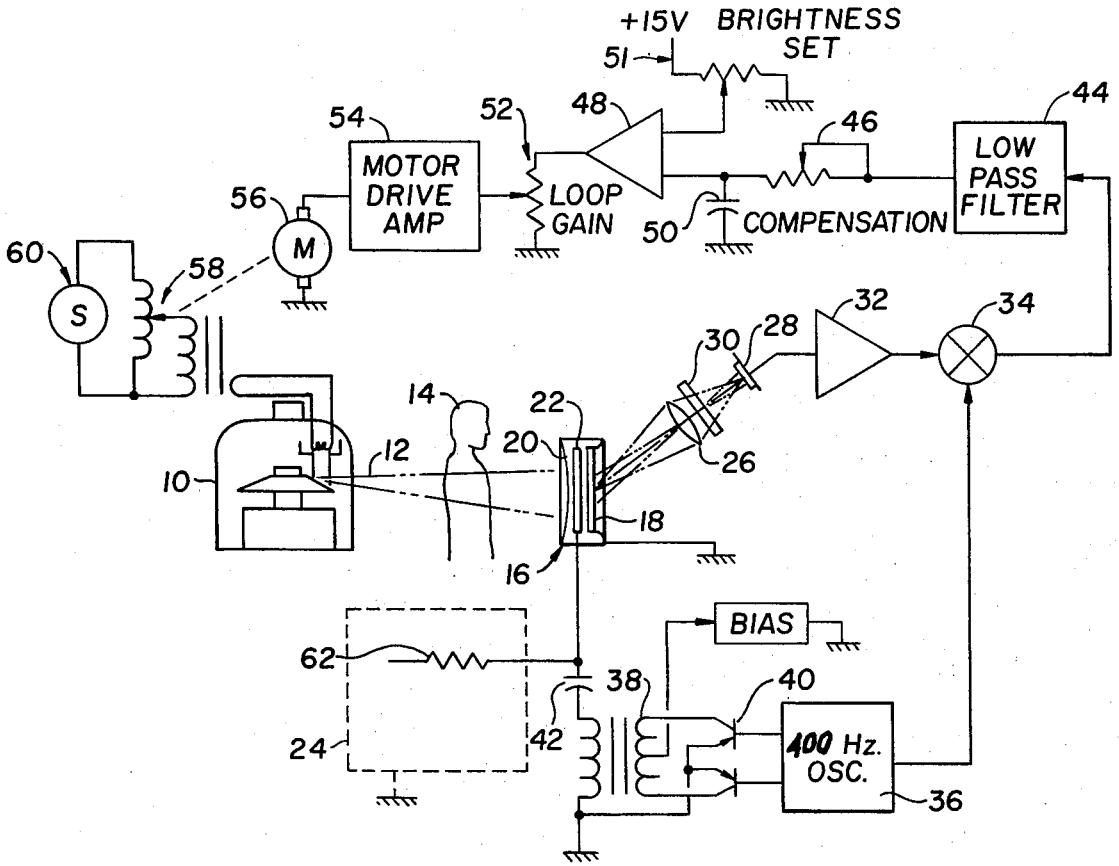
FIG. 1 is a schematic diagram of the automatic brightness control apparatus according to one embodiment of the invention.
Figure 2:
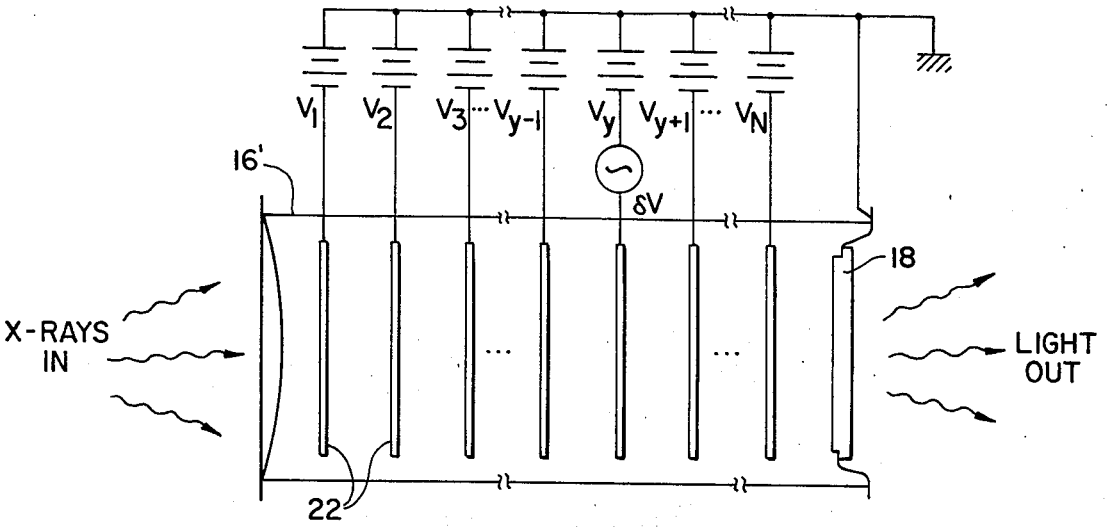
FIG. 2 is a schematic diagram for use in explaining a modification of the invention for use with multistage image intensifier tubes.

Referring now more particularly to the FIG. 1, an X-ray generator tube 10 generates a beam of X-rays 12 which pass through the object to be X-rayed 14 and cast an X-ray image shadow onto the image intensifier tube 16.

The image intensifier tube 16 is preferably of the proximity type which has a large area output screen 18 whose diameter is approximately the same as the input entrance window 20 of the tube 16.

The proximity image intensifier tube is of a type which is manufactured by Diagnostic Information, Inc., the assignee of the present application. This tube is disclosed in greater detail in pending U.S. patent applications Ser. No. 741,430, now abandoned, X-RAY RADIOGRAPHIC CAMERA, filed Nov. 12, 1976 by Shih-Ping Wang; Ser. No. 763,637, now abandoned, X-RAY IMAGE INTENSIFIER TUBE filed Jan. 28, 1977, by Shih-Ping Wang; and Ser. No. 763,638, now Pat. No. 4,104,516, DIRECT VIEW, PANEL TYPE X-RAY IMAGE INTENSIFIER TUBE, filed Jan. 28, 1977 by Shih-Ping Wang, Charles D. Robbins and Elisha D. Merritt. The contents of these patent applications are incorporated herein by reference as though fully set forth. For the purpose of this patent application, however, the image intensifier tube can be of any design although the apparatus is particularly adapted for use with the proximity type image intensifier tube described in these patent applications. Suffice it to say for the purposes of this description, the image intensifier tube 16 operates by converting the X-ray image into a light image which in turn, is converted into a pattern of electrons which are accelerated between a scintillation screen assembly 22 and the output display screen 18. The scintillation screen 22 is operated at a negative high potential in the range of 10 to 60 kV supplied by a grounded high voltage power supply source 24. The tube envelope and output phosphor screen 18 are operated at ground potential.

When the accelerated electron pattern image strikes the output phosphor display screen 18, it produces a light image which is directly viewable as is well understood by those skilled in the art. A portion of this light image area, preferably the central 10% to 30% by area, is focused by means of an optical lens 26 onto a light sensitive photosensor 28. A filter 30 with a transmission spectrum approximately matching the emission spectrum of the output phosphor screen may also be interposed between the output phosphor display screen 18 and the photosensor 28 for rejecting light of a different wavelength than the light emitted by the output phosphor display screen 18. This helps to remove ambient light which is reflected off the output phosphor display screen and would otherwise impinge on the photosensor providing greater dynamic range. The electrical output signal from the photosensor is amplified by an operational amplifier 32 and is supplied to one input of a multiplier circuit 34.

Another input to the multiplier circuit 34 is supplied by a 400 Hz oscillator 36. As will be explained in greater detail hereinafter, the multiplier acts as a phase sensitive detector circuit. The multiplier circuit can be a commercially available circuit such as a Motorola Model MC 1496 circuit, for example. Since such a circuit is commercially available, its details will not be described.

The oscillator 36 also drives a center tapped primary winding of a high voltage transformer 38 through a pair of transistors 40. The secondary winding of the transformer 38 is connected in series with a capacitor 42 between the circuit ground and the image intensifier scintillation screen assembly 22. Thus, the high voltage bias supply 24 is connected in parallel with the series connection of the capacitor 42 and the secondary winding of the transformer 38. The capacitor 42 can be rated at 100 PF, 60 kV, for example.

The output of the multiplier 34 is supplied to the input of a low pass filter circuit 44 whose output is supplied through a variable resistance 46 to one input of a differential amplifier 48. This same input to the differential amplifier is connected to the circuit ground through a capacitor 50. Together the resistance 46 and the capacitor 50 constitute an adjustable RC compensation filter.

The other input to the amplifier 48 is from a variable bias voltage source 51 to allow the brightness of the output display screen 18 to be manually set, as will be explained in greater detail hereinafter. The output of the amplifier 48 is connected through a voltage divider circuit 52 to the input of a motor drive amplifier 54. Since the motor drive amplifier is simply a commercially available operational amplifier, its details will not be described since they are well understood by those skilled in the art. The output of the motor drive amplifier drives a servo motor 56. The servo motor 56 controls the setting of a variable transformer 58 whose primary is connected to an external alternating current source 60. The transformer 58 supplies filament current to the X-ray generator tube 10.

In operation, the X-ray generator tube 10 produces the beam of X-rays 12 which casts an X-ray image onto the scintillator assembly screen 22 of the image intensifier tube 16. A corresponding output display appears on the screen 18 and the center portion of this display is sensed by the photosensor 28. The output signal from the photosensor 28, termed $V_d$, can be approximated by the following formula:

$$V_d = I_d R_1 = [Rg\phi(V - V_o) + R\psi]kA$$

where $I_d$ = photocurrent of optical sensor $R_1$ = photosensor's load resistor g = intensifier tube gain per kilo volt of bias in $$\frac{cd}{m^2} / \frac{mr}{sec} / kv$$

$\phi$=X-ray dosage rate (mR/sec)

A=area of the output screen sensed by the photosensor ($cm^2$)

V=bias voltage associated with the X-ray intensifier tube (kV)

$V_o$=a low voltage threshold which the bias must exceed for intensifier operation (kV)

R=photosensor responsivity (volts/lumen)

$\psi$=ambient light brightness reflected off the output screen (lumens/$m^2$)

k=light collection factor of the lens

In order to render the control system insensitive to the ambient light term, the bias voltage—V—is modulated at some convenient rate such as 400 Hz/sec. Thus, the bias voltage becomes $$V=V_{dc}+v\cos\omega t$$

and eg. 1 may be rewritten $V_d=[Rg\phi(V_{dc}+v\cos\omega t-V_o)+R\omega]kA$

It is convenient to accomplish this modulation by simply coupling an ac signal capacitively directly to the image intensifier tube's photocathode while isolating the bias supply through a high voltage bias supply source 24. The effects of the ambient light as well as drifts in the bias voltage may thus be eliminated by sensing only the ac (400 Hz/sec. for example) component of the light emission from the output display screen of the X-ray image intensifier tube and using this term to control the X-ray intensity. This detection is done by the multiplier 34. The component v may typically be 4 kV peak to peak while $V_{dc}$ might be −30 kV to −60 kV. Therefore, by introducing a small sinusoidal variation to the bias supply and detecting only the resultantly modulated light output at the output display screen 18, the X-ray generator may be controlled to obtain a relatively constant output window brightness. The error signal derived by detecting only the modulated light component is independent of dark current and power frequency components common to the X-ray generated light output of the image intensifier tube.

Referring now more particularly to FIGS. 2 through 5, inclusive, the general principles of this invention can be extended to include multistage intensifier tubes. Consider the general multistage intensifier of FIG. 2 consisting of N stages. The overall gain of the composite tube will be of the form:

$$\text{Gain}=g_1(V_1-V_2-V_{01})g_2(V_2-V_3-V_{02})\ldots g_N(V_N-V_{ON})=G_o$$

where the g parameters are gain constants associated with each tube stage and the $V_{ON}$ are threshold voltages for each stage that must be exceeded to produce gain ($V_j-V_{j-1}>V_{ON}$).

With several stages the modulating voltage may be applied to any electrode of the tube. However it will be shown that if all electrodes are connected to "solid" regulated supplies injection of a modulating voltage to any but the first stage will result in a minimal perturbation of the gain.

Assume a perturbing voltage, $\delta V$, to be applied to the jth electrode. Then the tube gain will become:

$$\text{Gain} = g_1(V_1-V_2-V_{01})\ldots g_j(V_j+\delta V-V_{j-1}-V_{oj})\, g_{j+1}(V_{j+1}-V_j-\delta V-V_{oj+1})\ldots g_N(V_N-V_{ON})$$

-continued $$\cong G_o\left(1+\frac{\delta V}{V_j-V_{j-1}-V_{oj}}\right)\left(1-\frac{\delta V}{V_{j+1}-V_j-V_{oj+1}}\right) = G_o\left(1+\delta V\left\{\frac{1}{E_j}-\frac{1}{E_{j+1}}\right\}\right)$$

where $E_j=V_j-V_{j-1}-V_{oj}$ is the effective voltage which produces gain in the yth stage. If the adjacent stages have similar characteristics, then to first order, $E_j=E_{j+1}$ and the effect of $\delta V$ cancels out. However, if $\delta V$ were injected at the first stage, then $$\text{Gain} = G_o\left(1+\frac{\delta V}{E_1}\right)$$

and a significant gain perturbation occurs. Note that if all stages are similar then the tube gain is approximately $$\text{Gain}=g_1\ldots g_N E^N$$

Figure 3:
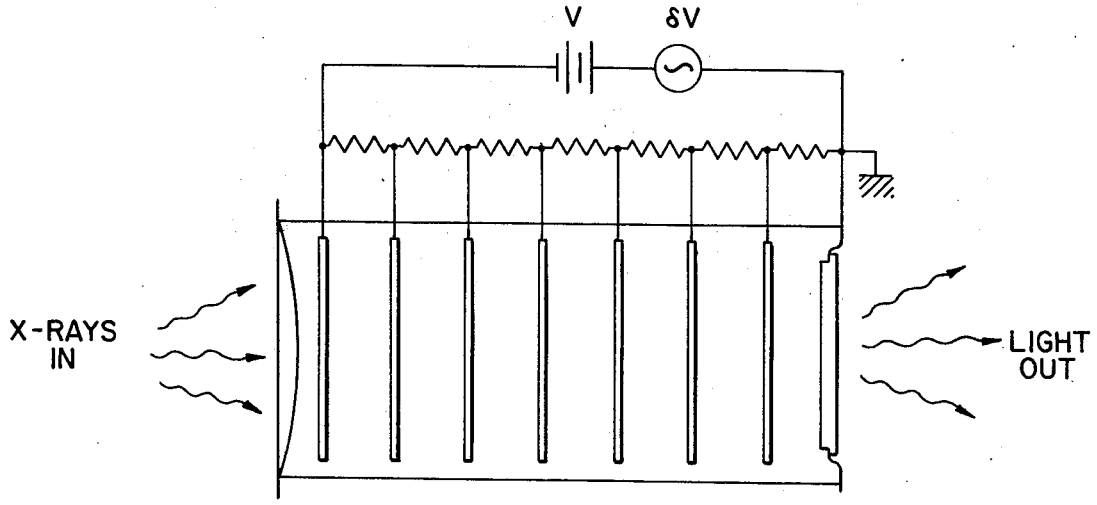
FIG. 3 is a schematic diagram of a second embodiment of the invention for use with a multistage intensifier tube.

FIG. 3 demonstrates a second manner in which the tube voltages may be derived from a resistive network with the modulating voltage being injected in series with the high voltage source. In this case, the effective voltage for each stage is $$E_j=V_j-V_{j-1}-V_{oj}=\alpha_j(V+\delta V)-V_{oj}$$

where $\alpha_j(V+\delta V)$ is the fraction of the applied voltage appearing across the jth stage. Obviously, $$\sum_{j=1}^{N}\alpha_j=1$$

The tube gain, in this instance, becomes $$\text{Gain} = g_1(\alpha_1(V+\delta V)-V_{01})\, g_2(\alpha_2(V+\delta V)-V_{02}\ldots g_N(\alpha_N(V+\delta V)-V_{ON}) = G_o\left(1+\frac{\alpha_1\delta^V}{E_1}+\frac{\alpha_2\delta^V}{E_2}+\ldots\right) = G_o\left(1+\delta V\sum_{j=1}^{N}\frac{\alpha_j}{E_j}\right)$$

If all $E_j$ are approximately equal to the same value, E, $$\text{Gain}=G_o(1+\alpha V/E)$$

Figure 4:
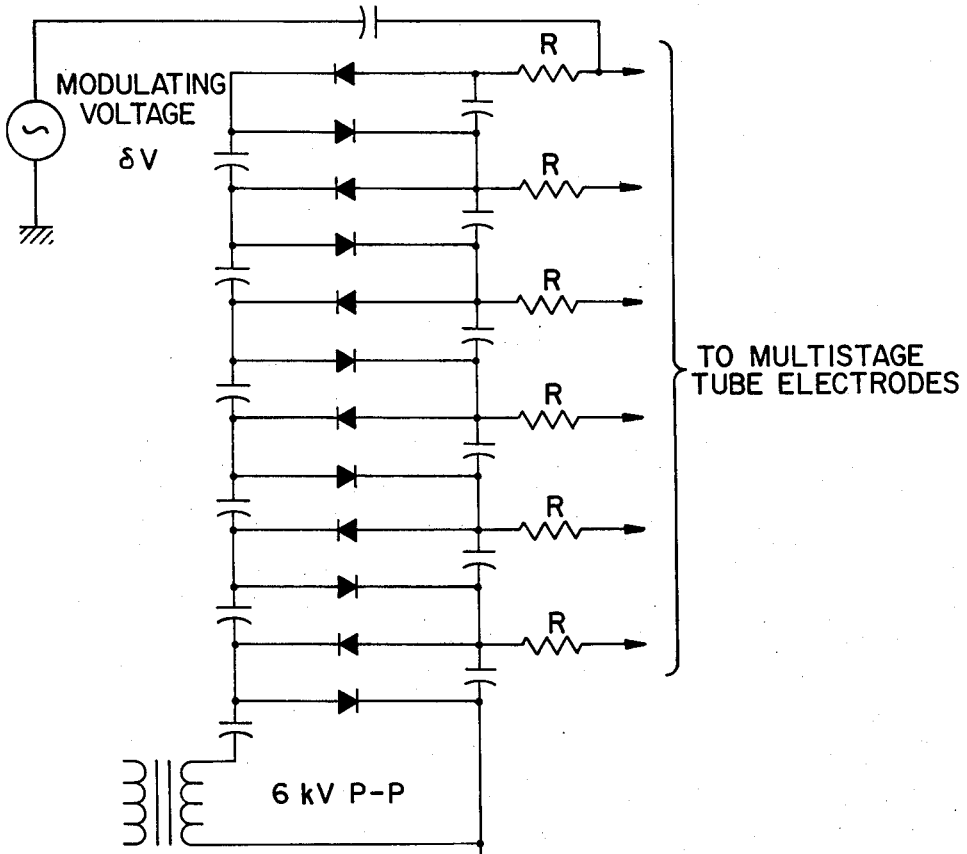
FIG. 4 is a schematic diagram of a third embodiment of the invention for use with multistage image intensifier tubes.
Figure 5:
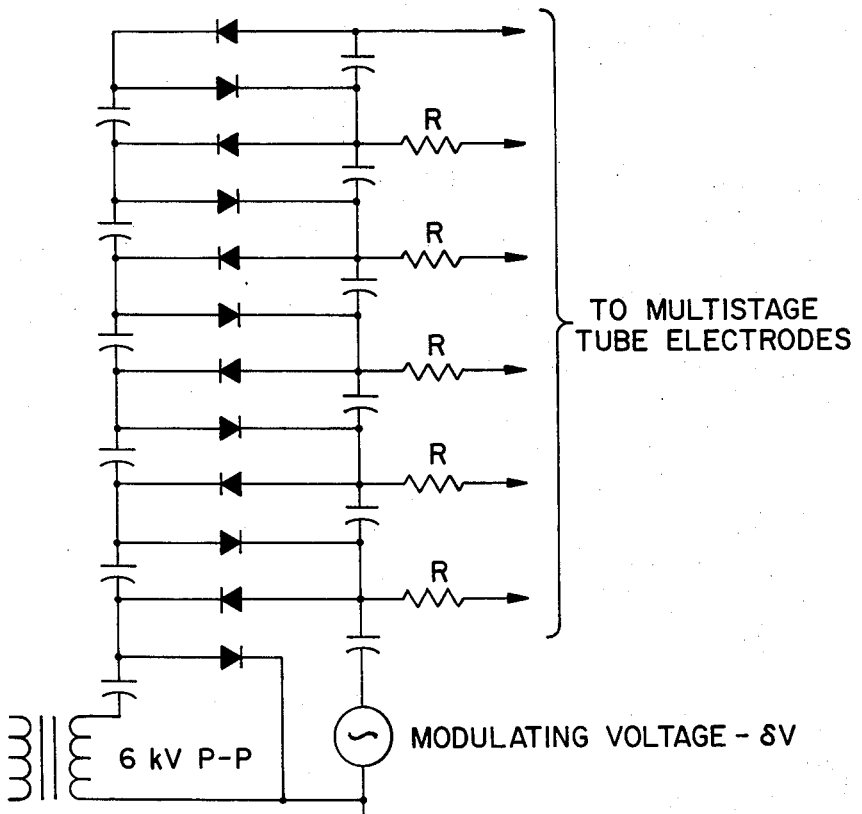
FIG. 5 is a schematic diagram of a fourth embodiment of the invention for use with multistage image intensifier tubes.

Thus there are several ways of impressing the modulating voltage, $\delta V$, across the multistage tube to produce a first order light perturbation. As heretofore described, the modulating voltage may be capacitively coupled to the first stage of the tube as shown in FIG. 1, wherein the other electrode voltages are obtained from a resistive divider network connected across the high voltage supply. Alternatively, a capacitance-diode high voltage multiplier of the Cockroft-Walton variety may be used with the tube electrodes being attached to the several stages of the voltage multiplier as shown in FIGS. 4 and 5. In the embodiment of FIG. 4, the modulating voltage is applied at the top of the multiplier stack whereas in the embodiment of FIG. 5, the modulating voltage is applied at the bottom of the stack. The resistors—R—are generally required to safeguard the tube against excess current surges during transient arc-overs known to occur in such tubes. The remainder of the circuit is as shown and described in reference in FIG. 1.

This method of achieving automatic brightness control is particularly suitable for image intensifier tubes of the proximity or multistage proximity design. This is because the modulation of stage voltage does not affect the focusing properties of the tube. Whereas, in the case of electrostatic inverter design, the modulation of tube or stage (or electrode) voltage would affect the focusing property of the tube.

The terms and expressions which have been employed herein are used as terms of description and not of limitation, and there is no intention in the use of such terms and expressions, of excluding equivalents of the features shown and described or portions thereof, it being recognized that various modifications are possible within the scope of the invention claimed.

What is claimed is:

1. Automatic brightness control apparatus for use with a variable intensity X-ray generator and an X-ray image intensifier tube of the type having a high voltage bias supply and an output phosphor display screen, the brightness control apparatus comprising oscillator means for introducing a periodic variation in the bias supply voltage to the image intensifier tube to thereby produce a corresponding periodic brightness variation in the light output of the output display screen, photo-optic sensor means for sensing the light output of the display screen and for producing an output signal representative of variations in the intensity of such light output, means for phase detecting the periodically varying component of the photo-optic sensor means output signal due to the oscillator means and for thereby producing an X-ray generator intensity control signal.

2. Automatic brightness control apparatus as recited in claim 1 further comprising light filter means interposed between the photo-optic sensor and the display screen for rejecting light wavelengths different from the light wavelengths emitted by the output phosphor display screen.

3. Automatic brightness control apparatus as recited in claim 1 further comprising means supplied with the X-ray generator intensity control signal for controlling the intensity of the output of the X-ray generator in response thereto.

4. Automatic brightness control apparatus as recited in claim 1 wherein the image intensifier tube is of the proximity type having an input window which is of substantially the same diagonal dimension as the output display screen.

5. Automatic brightness control apparatus as recited in claim 1 wherein the oscillator means comprise an oscillator, a high voltage transformer having a primary winding and a secondary winding, the secondary winding being connected in parallel with the high voltage bias supply of the image intensifier tube and the primary winding being connected to be driven by the oscillator, the oscillator further being electrically connected to the phase detection means.

6. Automatic brightness control apparatus as recited in claim 1 wherein the photo-optic sensor means include a photosensor and optical means for imaging a central portion of the output phosphor screen display onto the photosensor.

7. Automatic brightness control apparatus as recited in claim 1 wherein the X-ray image intensifier is of the type having multiple intensification stages and wherein the oscillator means introduce the periodic variation solely to the first of the multiple intensification stages.

8. Automatic brightness control apparatus as recited in claim 1 wherein the X-ray image intensifier is of the type having multiple intensification stages and the bias supply is a voltage multiplier stack, and wherein the oscillator means introduce the periodic variation solely to the top of the multiplier stack.

9. Automatic brightness control apparatus as recited in claim 1, wherein the X-ray image intensifier is of the type having multiple intensification stages and the bias supply is a voltage multiplier stack, and wherein the oscillator means introduce the periodic variation solely to the bottom of the multiplier stack.

* * * * *